US007204112B1

(12) United States Patent
Durand et al.

(10) Patent No.: US 7,204,112 B1
(45) Date of Patent: Apr. 17, 2007

(54) METHOD OF LUBRICATING A WORKPIECE FOR HYDROFORMING

(75) Inventors: Robert D. Durand, Reading, PA (US); Richard A. Marando, Mohrsville, PA (US); Eric M. Schrack, Shartlesville, PA (US)

(73) Assignee: Dana Corporation, Toledo, OH (US)

( * ) Notice: Subject to any disclaimer, the term of this patent is extended or adjusted under 35 U.S.C. 154(b) by 187 days.

(21) Appl. No.: 10/334,106

(22) Filed: Dec. 30, 2002

(51) Int. Cl.
*B21B 45/02* (2006.01)

(52) U.S. Cl. ..... 72/43; 72/41; 72/60; 72/342.1

(58) Field of Classification Search ..... 72/41, 72/42, 43, 44, 45, 46, 54, 56, 39, 58, 61, 72/60, 57; 184/6.22; 148/246; 427/372.2, 427/421.1, 226, 318; 118/58, 59, 308; 134/4, 134/9

See application file for complete search history.

(56) References Cited

U.S. PATENT DOCUMENTS

| | | | | | |
|---|---|---|---|---|---|
| 2,040,767 | A | | 5/1936 | Dudley | |
| 2,962,808 | A | * | 12/1960 | Cole et al. | 29/424 |
| 3,560,692 | A | | 2/1971 | Briles | |
| 3,760,488 | A | * | 9/1973 | Cucuz et al. | 29/557 |
| 3,789,641 | A | * | 2/1974 | Miller et al. | 72/45 |
| 3,800,522 | A | | 4/1974 | Hughes et al. | |
| 3,974,674 | A | * | 8/1976 | Orozco et al. | 72/42 |
| 4,080,131 | A | | 3/1978 | Bahder et al. | |
| 4,683,742 | A | * | 8/1987 | Eveson | 72/43 |
| 4,735,734 | A | * | 4/1988 | Staub et al. | 508/131 |
| 5,020,350 | A | * | 6/1991 | Knepp et al. | 72/45 |
| 5,325,601 | A | | 7/1994 | Brownewell et al. | |
| 5,495,737 | A | * | 3/1996 | Graham | 72/42 |
| 5,584,201 | A | * | 12/1996 | Graham et al. | 72/42 |
| 5,819,572 | A | * | 10/1998 | Krajewski | 72/42 |
| 6,063,447 | A | * | 5/2000 | Morand et al. | 427/388.4 |
| 6,231,687 | B1 | * | 5/2001 | Kobayashi et al. | 148/246 |
| 6,253,588 | B1 | * | 7/2001 | Rashid et al. | 72/57 |
| 6,330,818 | B1 | * | 12/2001 | Jain | 72/42 |
| 6,430,980 | B1 | * | 8/2002 | Weinhold et al. | 72/43 |
| 6,454,052 | B2 | * | 9/2002 | Wu | 184/55.1 |
| 6,455,476 | B1 | * | 9/2002 | Imai et al. | 508/156 |
| 6,477,774 | B1 | | 11/2002 | Marando et al. | |
| 6,532,784 | B1 | * | 3/2003 | Dunn et al. | 72/42 |
| 6,722,014 | B2 | * | 4/2004 | Newman | 29/527.2 |
| 6,761,931 | B1 | * | 7/2004 | Cochran et al. | 427/314 |

FOREIGN PATENT DOCUMENTS

| | | |
|---|---|---|
| EP | 13013 | * 12/1979 |

* cited by examiner

*Primary Examiner*—Ed Tolan
(74) *Attorney, Agent, or Firm*—MacMillan, Sobanski & Todd, LLC

(57) ABSTRACT

An apparatus and method of applying a lubricating material to an outer surface of a workpiece. Initially, a workpiece is provided that is preferably formed from a closed channel structural member having a circular or box-shaped cross sectional shape. Lubricating material is applied to an outer surface of the workpiece. In a second step of the method, the workpiece may be heat treated. The workpiece is then heated to elevate the temperature of the workpiece so as to cause the lubricating material to dry substantially immediately on the workpiece, thereby providing a coating of lubricating material having a substantially uniform thickness. In a fourth step of the method, a deforming process is performed on the workpiece during the period of time following the heat treatment process, and after applying the lubricating material, in which the workpiece retains the full or partial softening characteristics.

18 Claims, 3 Drawing Sheets

METHOD OF LUBRICATING A WORKPIECE FOR HYDROFORMING

BACKGROUND OF THE INVENTION

This invention relates in general to the manufacture of structural members having desired shapes, such as components for use in vehicle frame assemblies. More specifically, this invention relates to an improved apparatus and method for applying a lubricating material to a workpiece, such as a closed channel structural member, to facilitate the performance of a subsequent deforming process so as to manufacture a vehicle frame component having a desired shape for use in such a vehicle frame assembly.

Many land vehicles in common use, such as automobiles, vans, and trucks, include a body and frame assembly that is supported upon a plurality of ground-engaging wheels by a resilient suspension system. The structures of known body and frame assemblies can be divided into two general categories, namely, separate and unitized. In a typical separate body and frame assembly, the structural components of the body portion and the frame portion are separate and independent from one another. When assembled, the frame portion of the assembly is resiliently supported upon the vehicle wheels by the suspension system and serves as a platform upon which the body portion of the assembly and other components of the vehicle can be mounted. Although separate body and frame assemblies of this general type have been widely used in the past, they are commonly used today primarily for relatively large or specialized use modern vehicles, such as large vans, sport utility vehicles, and trucks. In a typical unitized body and frame assembly, the structural components of the body portion and the frame portion are combined into an integral unit that is resiliently supported upon the vehicle wheels by the suspension system. Unitized body and frame assemblies of this general type are found in many relatively small modern vehicles, such as automobiles and minivans.

One well known example of a separate type of vehicular body and frame assembly is commonly referred to as a ladder frame assembly. A ladder frame assembly includes a pair of longitudinally extending side rails that are joined together by a plurality of transversely extending cross members. The cross members connect the two side rails together and provide desirable lateral, vertical, and torsional stiffness to the ladder frame assembly. The cross members can also be used to provide support for various components of the vehicle. Depending upon the overall length of the vehicle and other factors, the side rails of a conventional ladder frame assembly may be formed either from a single, relatively long structural member or from a plurality of individual, relatively short structural members that are secured together. For example, in vehicles having a relatively short overall length, it is known to form each of the side rails from a single integral structural member that extends the entire length of the vehicle body and frame assembly. In vehicles having a relatively long overall length, it is known to form each of the side rails from two or more individual structural members that are secured together, such as by welding, to provide a unitary structural member that extends the entire length of the vehicle body and frame assembly.

Traditionally, the various components of known vehicle body and frame assemblies have been formed from open channel structural members, i.e., structural members that have a non-continuous cross sectional shape (U-shaped or C-shaped channel members, for example). Thus, it is known to use one or more open channel structural members to form the side rails, the cross members, and other components of a vehicle body and frame assembly. However, the use of open channel structural members to form the various components of vehicle body and frame assemblies has been found to be undesirable for several reasons. First, it is relatively time consuming and expensive to bend portions of such components to conform to a desired final shape, as is commonly necessary. Second, after such bending has been performed, a relatively large number of brackets or other mounting devices must usually be secured to some or all of such components to facilitate the attachment of the various parts of the vehicle to the body and frame assembly. Third, in some instances, it has been found difficult to maintain dimensional stability throughout the length of such components, particularly when two or more components are welded or otherwise secured together.

To address some of the problems of open channel structural members, it has been proposed to form one or more of the various vehicle body and frame components from closed channel structural members, i.e., structural members that have a continuous cross sectional shape (tubular or box-shaped channel members, for example). This closed cross sectional shape is advantageous because it provides strength and rigidity to the vehicle body and frame component. Also, this cross sectional shape is desirable because it provides vertically and horizontally oriented side surfaces that facilitate the attachment of brackets and mounts used to support the various parts of the vehicle to the body and frame assembly. In some instances, the various parts of the vehicle may be directly attached to the vertically and horizontally oriented side surfaces of the vehicle body and frame assembly.

In the manufacture of vehicle body and frame assemblies of this type, it is known that the closed channel structural member may be deformed to a desired shape by hydroforming. Hydroforming is a well known process that uses pressurized fluid to deform a closed channel structural member into a desired shape. To accomplish this, the closed channel structural member is initially disposed between two die sections of a hydroforming apparatus. When the two die sections are closed together, they define a die cavity having a desired final shape. Thereafter, the closed channel structural member is filled with a pressurized fluid, typically a relatively incompressible liquid such as water. The pressure of the fluid is increased to a magnitude where the closed channel structural member is expanded or otherwise deformed outwardly into conformance with the die cavity. As a result, the closed channel structural member is deformed into the desired final shape.

Hydroforming has been found to be a desirable forming process because portions of a closed channel structural member can be quickly and easily deformed to acquire a complex cross sectional shape. In those instances where the perimeter of the closed channel structural member is not the same as the perimeter of the die cavity, the cross sectional shape of the closed channel structural member is changed during the hydroforming process. However, at least ideally, the wall thickness of the closed channel structural member should remain relatively constant throughout the deformed region. Hydroforming has also been found to be a desirable forming process because portions of a closed channel structural member can be quickly and easily expanded from a relatively small perimeter to a relatively large perimeter. In those instances where the perimeter of the closed channel structural member is somewhat smaller than the perimeter of the die cavity, not only is the cross sectional shape of the closed channel structural member changed during the hydroforming process, but the wall thickness thereof is decreased. However, at least ideally, the wall thickness of the closed channel structural member should decrease uniformly through the expanded region.

During the hydroforming operation, because the inner surface of the hydroforming die is typically shaped differently from the outer surface of the closed channel structural member, one or more discrete portions of the outer surface of the closed channel structural member will initially engage the inner surface of the hydroforming die prior to engagement by the remaining portions thereof. These initially engaging portions of the outer surface of the closed channel structural member may become frictionally locked in position at the points of engagement because of the outwardly directed forces generated by the high pressure hydroforming fluid. As a result, the remaining portions of the closed channel structural member are stretched from the initially engaging portions as the deformation of the closed channel structural member is completed.

Such stretching results in undesirable variations of the wall thickness variations throughout the perimeter of the closed channel structural member. These wall thickness variations can be particularly acute when the hydroforming operation not only deforms the perimeter of the closed channel structural member, but also expands the magnitude of the perimeter thereof. Further, these wall thickness variations can result in undesirable weaknesses in the formed closed channel structural member.

Such friction between the outer surface of the closed channel structural member and the inner surface of the die may have adverse effects on the structural member. To minimize any adverse effects of such friction, it is known to coat the outer surface of the structural member with a lubricant prior to hydroforming. The lubricant is typically sprayed or applied by other suitable means and allowed to dry at room temperature. This process often results in an undesirable non-uniform coating of lubricant. Thus, it would be desirable to provide an improved method for applying lubricating material to a closed channel structural member prior to hydroforming, wherein the lubricating material maintains a relatively uniform wall thickness throughout.

SUMMARY OF THE INVENTION

This invention relates to an improved apparatus and method for applying a lubricating material to a workpiece, such as a closed channel structural member, to facilitate the performance of a subsequent deforming process so as to manufacture a vehicle frame component having a desired shape for use in such a vehicle frame assembly. According to this invention there is also provided, a method of applying a lubricating material to an outer surface of a workpiece, including providing a workpiece, and applying a lubricating material to an outer surface of the workpiece. The workpiece is heated to elevate the temperature of the workpiece so as to cause the lubricating material to dry substantially immediately on the workpiece, thereby providing a coating of lubricating material having a substantially uniform thickness. The workpiece is then subjected to a hydroforming process. According to this invention there is also provided a method of applying a lubricating material to an outer surface of a workpiece. A workpiece is provided, and it is heated to elevate the temperature of the workpiece. A lubricating material is applied to an outer surface of the workpiece, wherein the lubricating material dries substantially immediately on the workpiece, due to the elevated temperature of the workpiece, thereby providing a coating of lubricating material having a substantially uniform thickness. The workpiece is subjected to a hydroforming process.

Various objects and advantages of this invention will become apparent to those skilled in the art from the following detailed description of the preferred embodiment, when read in light of the accompanying drawings.

DETAILED DESCRIPTION OF THE PREFERRED EMBODIMENTS

Figure 1:
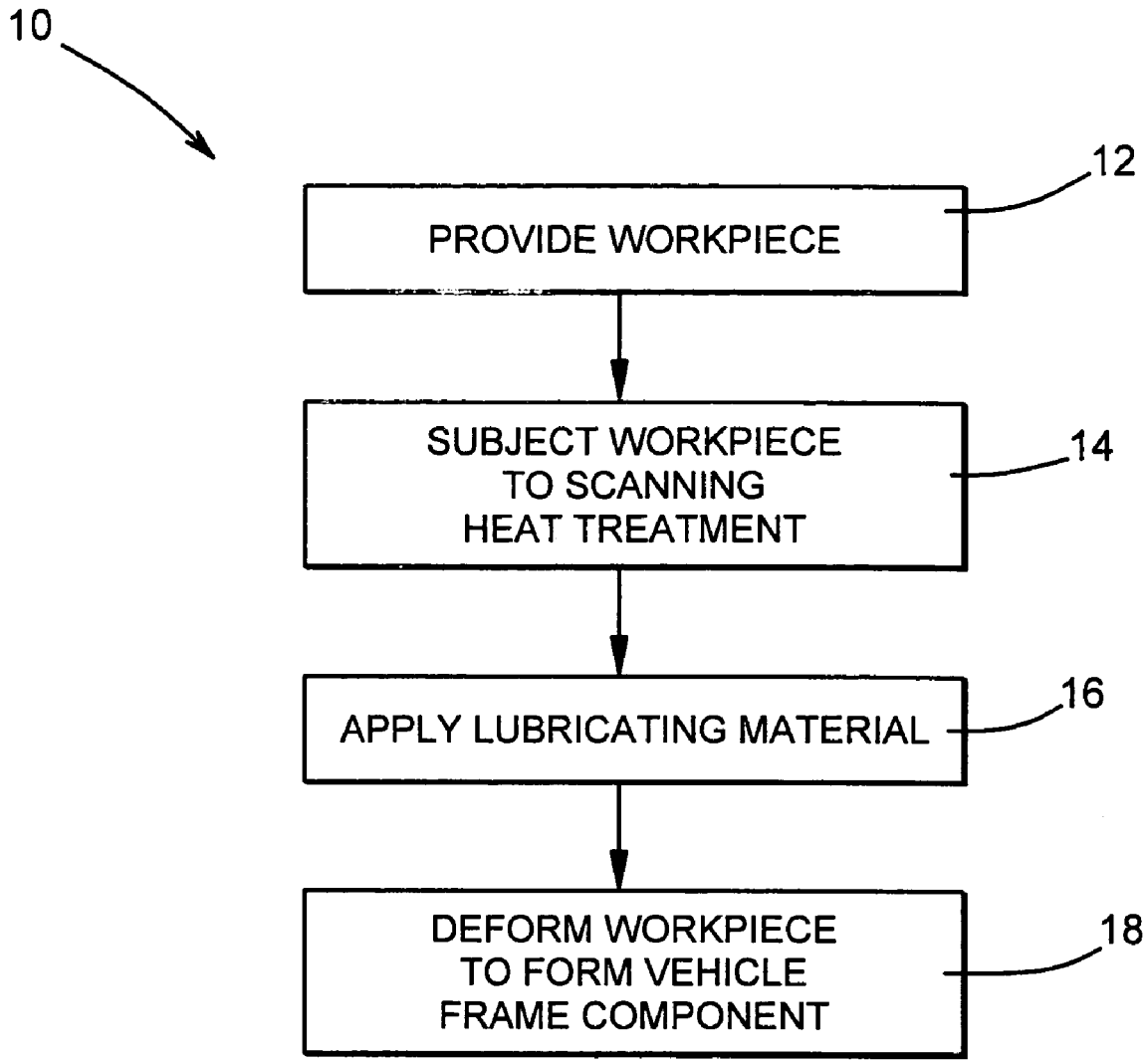
FIG. 1 is a flow chart of a method for manufacturing a vehicle frame assembly in accordance with the method of this invention.

Referring now to the drawings, there is illustrated in FIG. 1 a flow chart of a method, indicated generally at 10, for manufacturing a vehicle frame assembly in accordance with this invention. In a first step 12 of the method 10, a workpiece that is to be manufactured into the vehicle frame component is provided. As will be explained in greater detail below, the workpiece is preferably a closed channel structural member having a circular or box-shaped cross sectional shape. However, the workpiece may be formed having any desired cross sectional shape. The workpiece is preferably formed from a relatively lightweight metallic material, such as aluminum or alloys thereof. However, any desired metallic material may be used to form the workpiece.

In a second step 12 of the method 10, the workpiece is subjected to a scanning heat treatment process. U.S. patent application Ser. No. 09/408,747 to Kichline, Jr. et al., owned by the assignee of this invention describes such a heat treatment process and is incorporated by reference. The scanning heat treatment process can be generally characterized as any process for heat treating the workpiece in a continuous and longitudinal manner from one end to the other. This can be accomplished by initially positioning a first end of the workpiece adjacent to a hollow heat treatment mechanism, such as an annular induction coil. Then, the workpiece is moved longitudinally through the heat treatment mechanism such that it is heat treated in a continuous and longitudinal manner from one end to the other as it passes therethrough. Preferably, the heat treatment is a retrogression heat treatment process. Generally speaking, the retrogression heat treatment process is performed by rapidly heating the workpiece to a temperature sufficient to provide for full or partial softening thereof, followed by relatively rapid cooling. Notwithstanding this cooling, the workpiece retains the full or partial softening characteristics for at least a relatively short period of time.

The third step 16 of the method 10 involves applying a lubricating material to an outer surface of the workpiece, as will be explained in greater detail below. The workpiece is heated to elevate the temperature of the workpiece so as to cause the lubricating material to dry substantially immediately when applied on the workpiece. This process provides a coating of lubricating material having a substantially uniform thickness.

The fourth step 18 of the method 10 involves performing a deforming process on the workpiece. Preferably, this deforming is performed during the period of time following the retrogression heat treatment process, and after the application of the lubricating material, in which the workpiece retains the full or partial softening characteristics. Any desired deforming process may be performed on the workpiece. If, for example, the workpiece is a closed channel structural member, the deforming process may be performed by hydroforming. Hydroforming is a well known process that uses pressurized fluid to deform a closed channel structural member into a desired shape. U.S. Pat. No. 6,016,603 to Marando et al., and owned by the assignee of this invention, discloses a method of hydroforming a vehicle frame component, and is incorporated by reference. To accomplish the hydroforming, the closed channel structural member is initially disposed between two die sections of a hydroforming apparatus that, when closed together, define a die cavity having a desired final shape. Thereafter, the closed channel structural member is filled with a pressurized fluid, typically a relatively incompressible liquid such as water. The pressure of the fluid is increased to a magnitude where the closed channel structural member is expanded or otherwise deformed outwardly into conformance with the die cavity. As a result, the closed channel structural member can be deformed into the desired final shape for the vehicle frame component by the hydroforming process.

The deforming process may alternatively be performed by magnetic pulse forming. Magnetic pulse forming is also a well known process that uses an electromagnetic field to deform a workpiece into a desire shape. To accomplish this, an electromagnetic coil is provided for generating an intense magnetic field about the workpiece. When this occurs, a large pressure is exerted on the workpiece, causing it to be deformed against a support surface. If the electromagnetic coil is disposed about the exterior of the workpiece, then the workpiece is deformed inwardly into engagement with the support surface. If, on the other hand, the electromagnetic coil is disposed within the interior of the workpiece, then the workpiece is deformed outwardly into engagement with the support surface. In either event, the workpiece can be deformed into the desired final shape for the vehicle frame component by the magnetic pulse forming process.

Figure 2:
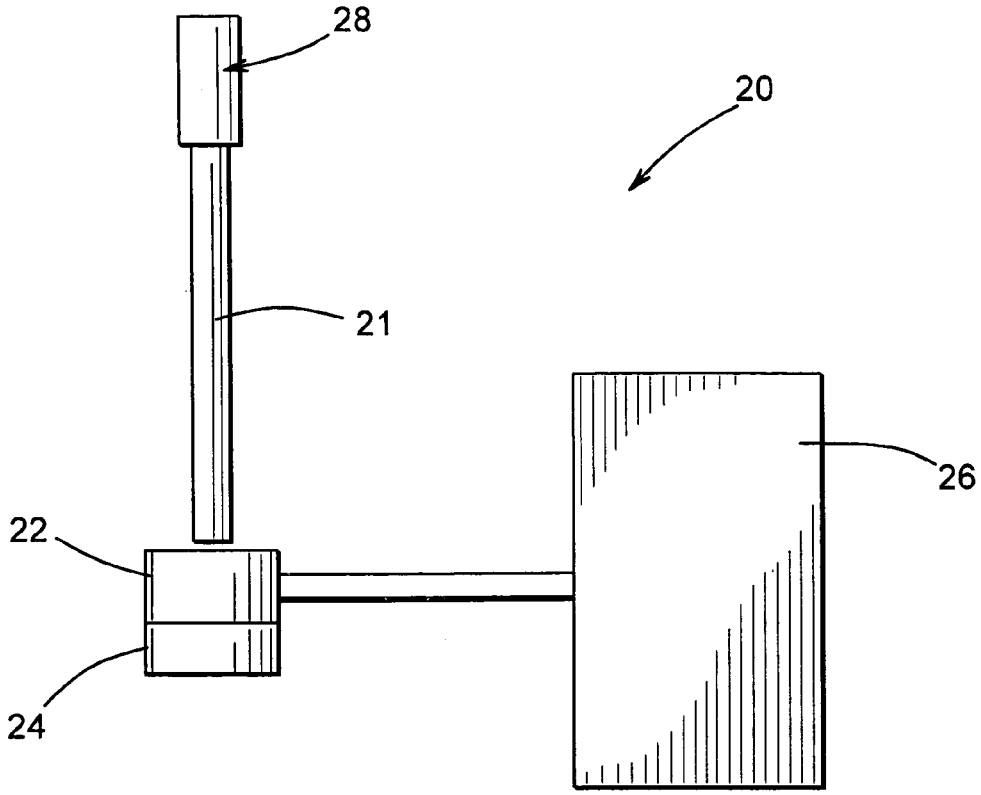
FIG. 2 is a schematic side elevational view of an apparatus for applying lubricating material on a workpiece in accordance with the present invention.

FIG. 2 is a schematic side elevational view of a first embodiment of an apparatus, indicated generally at 20, for applying a lubricating material to a workpiece 21 in accordance with this invention. Preferably, the lubricating material is a liquid lubricant. The apparatus 20 includes an annular induction heating coil 22 and a spray ring 24 that are preferably disposed immediately adjacent one another, as illustrated. The spray ring 24 is annularly-shaped and is disposed concentrically about the workpiece 21. The induction heating coil 22 is conventional in the art and is connected to a control circuit 26 for selectively causing an electrical current to flow therethrough. The operation of the induction heating coil 22 and the spray ring 24 will be explained further below. The apparatus 20 further includes a support mechanism, a portion of which is illustrated at 28. The illustrated support mechanism 28 is structured so as to suspend the workpiece 21 vertically downwardly from the end engaged by the support mechanism 28, although other means of suspension can be used.

FIG. 2 illustrates the locations of the support mechanism 28 and the workpiece 21 at the commencement of the application of the lubricating material. As shown therein, the workpiece 21 is initially suspended vertically above the induction heating coil 22 and the spray ring 24 by the support mechanism 28. Then, the support mechanism 28 is operated to lower the workpiece 21 vertically downwardly through the induction heating coil 22 and the spray ring 24. As this occurs, an electrical current is passed through the induction heating coil 22 by the control circuit 26. As is well known, when an electrical current is passed through the induction heating coil 22, corresponding electrical currents are induced to flow within the metallic workpiece 21. Because of the internal electrical resistance of the metallic workpiece 21 to the flow of electrical current, these induced electrical currents are converted to heat energy. As a result, the leading end of the workpiece 21 that is initially disposed within the induction heating coil 22 is rapidly heated to an elevated temperature. If desired, other heating structures may be provided in lieu of the induction heating coil 22.

Figure 3:
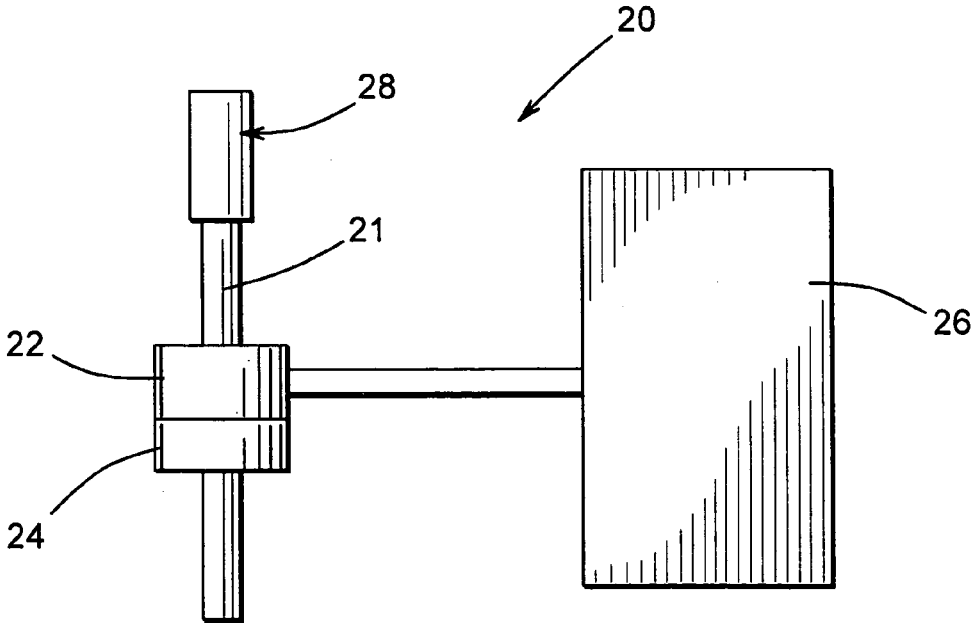
FIG. 3 is a schematic side elevational view similar to FIG. 2 showing the workpiece at an intermediate position during the application of a lubricating material.

FIG. 3 shows the support mechanism 28 and the workpiece 21 at a subsequent stage of the process of applying a lubricating material. In FIG. 3, the support mechanism 28 and the workpiece 21 are located at an intermediate position relative to the induction heating coil 22 and the spray ring 24 during the process of applying a lubricating material. As is apparent from these drawings, the support mechanism 28 is effective to lower the workpiece 21 longitudinally downwardly through the induction heating coil 22 such that the workpiece 21 is heated in a continuous and longitudinal manner from the leading end to the trailing end.

By using the annularly-shaped spray ring 24 of the invention, the lubricating material can be evenly distributed on the outside surface of the workpiece 21. Preferably, the lubricating material is applied to the outer surface of the workpiece 21 after the workpiece has been heated by the induction heating coil 22. Thus, after the leading end of the workpiece 21 has been moved downwardly through the induction heating coil 22 and rapidly heated, it is immediately moved downwardly through the spray ring 24, wherein the liquid lubricant is applied. The temperature of the workpiece 21 is elevated so as to cause the liquid lubricant to dry substantially immediately on the workpiece. Such rapid drying provides a coating of lubricating material having a substantially uniform thickness. As a practical matter, the immediacy of the drying substantially prevents the lubricant from flowing or otherwise being deformed prior to hardening. If desired, other apparatus, such as a liquid coater, not shown, for applying the lubricating material may be provided in lieu of the spray ring 24. Thus, the support mechanism 28 is also effective to lower the workpiece 21 longitudinally downwardly through the spray ring 24 such that lubricant is also applied to the workpiece 21 in a continuous and longitudinal manner from the leading end to the trailing end after being heated. Another advantage of using a circular or annularly-shaped spray head 24 in close proximity to the induction heating coil 22 is that the workpiece can become quenched by the liquid lubricant from the spray ring 24. The quenching helps prepare the workpiece material for subsequent hydroforming by making the material more ductile.

Although the apparatus 20 is described as being adapted to initially heat the workpiece 21 with the induction heating coil 22, and subsequently apply the lubricating material with the spray ring 24, the lubricating process may be reversed. For example, the apparatus 20 may be adapted to initially apply the lubricating material with the spray ring 24, and subsequently heat the workpiece 21 with the induction heating coil 22. In this arrangement, the temperature of the workpiece 21 is also elevated so as to cause the liquid lubricant to dry substantially immediately on the workpiece 21, as described above. The induction heating coil 22 and the spray ring 24 are also illustrated as being adjacent one another. However, the induction heating coil 22 and the spray ring 24 may be spaced apart from one another.

At the conclusion of the process of applying the lubricating material, the workpiece 21 can be released from the support mechanism 28 and transferred to a transport mechanism (not shown) for delivery to an apparatus for deforming the workpiece 21 in accordance with the fourth step 18 of the method 10 described above. Preferably, the workpiece 21 is released from the support mechanism 28 without having to be retracted upwardly through the induction heating coil 22 and the spray ring 24. However, the workpiece 21 may be retracted upwardly through the induction heating coil 22 and the spray ring 24 before being transferred to the transport mechanism if desired. Accordingly, it can be seen that the process of applying lubricating material is performed on the workpiece 21 in a continuous and longitudinal manner from one end to the other.

As mentioned above, the workpiece 21 is preferably supported vertically during the application of lubricating material to prevent the shape thereof from becoming distorted. This is because vehicle frame components are frequently relatively long in length and are relatively heavy in weight. If a relatively long and heavy workpiece 21 is suspended horizontally at its two ends during the application of lubricating material, it is possible that the central portion thereof may bow downwardly or otherwise distort under the influence of gravity during or after the application of lubricating material. By suspending the workpiece 21 vertically during the application of lubricating material, the likelihood of such distortions is greatly reduced because the weight of the workpiece 21 is insufficient to cause any significant elongation or other shape distortion thereof.

FIGS. 2 and 3 illustrate a support mechanism 28 structured so as to suspend the workpiece 21 vertically downwardly from an upper end of the workpiece 21 (as viewed in FIGS. 2 and 3). However, the apparatus 20 may be arranged such that a support mechanism supports the workpiece 21 from a lower end of the workpiece 21 (as viewed in FIGS. 2 and 3). Such a support mechanism may then be operated to raise the workpiece vertically upwardly through the induction heating coil 22 and the spray ring 24. In a further alternative embodiment of the invention, the apparatus 20 may be arranged such that the workpiece 21 remains stationary, and the induction heating coil 22 and the spray ring 24 are arranged to be vertically raised or lowered about the workpiece.

Figure 4:
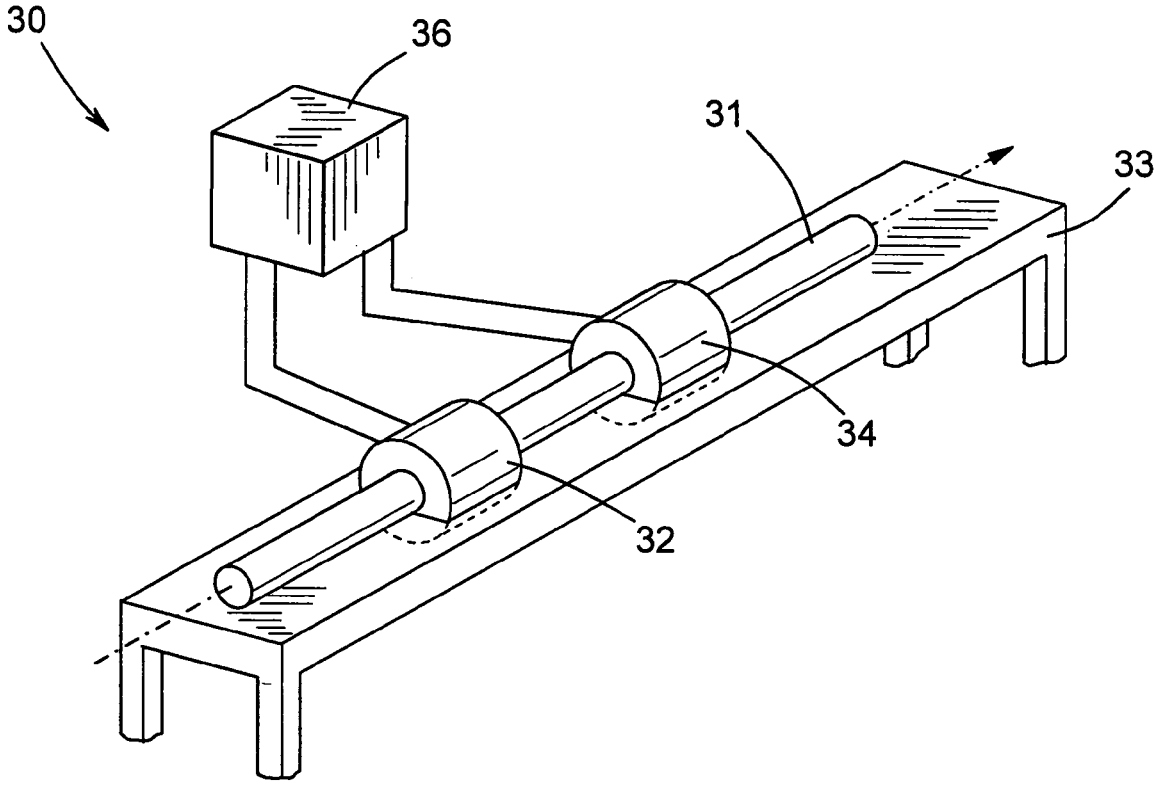
FIG. 4 is a schematic perspective view of an additional embodiment of the apparatus for applying lubricating material in accordance with the present invention.

FIG. 4 is a schematic perspective view of a second embodiment of an apparatus, indicated generally at 30, for applying a lubricating material to a workpiece 31 in accordance with this invention. The apparatus 30 includes a substantially horizontal support and transport mechanism 33. The illustrated support mechanism 33 is structured so as to support the weight of the workpiece 31 horizontally along the length of the workpiece 31. The apparatus 30 also includes an annular induction heating coil 32 and an annular spray ring 34 that may be disposed spaced-apart from one another, as illustrated. The induction heating coil 32 is conventional in the art and is connected to a control circuit 36 for selectively causing an electrical current to flow therethrough. The operation of the induction heating coil 32, the spray ring 32, and the control circuit 36 are essentially the same as described above. The support and transport mechanism 33 is effective to move the workpiece 31 horizontally to apply the lubricating material.

Although the apparatus 30 is described as being adapted to initially heat the workpiece 31 with the induction heating coil 32, and subsequently apply the lubricating material with the spray ring 34, the lubricating process may be reversed. For example, the apparatus 30 may be adapted to initially apply the lubricating material with the spray ring 34, and subsequently heat the workpiece 31 with the induction heating coil 32. In this arrangement, the temperature of the workpiece 31 is also elevated so as to cause the liquid lubricant to dry substantially immediately on the workpiece 31, as described above. The induction heating coil 32 and the spray ring 34 are illustrated as being spaced apart from one another. However, the induction heating coil 32 and the spray ring 34 may be adjacent one another as shown in FIGS. 2 and 3. Regardless of the order of the heating and lubricating steps, it can be seen that the heating and lubricating steps can be carried out by energizing an induction heating coil and a spray ring so as to spray lubricating material on the workpiece through the spray ring and to elevate the temperature of the workpiece so as to cause the lubricating material to dry substantially immediately on the workpiece, thereby providing a coating of lubricating material having a substantially uniform thickness. In a specific embodiment of the invention, the induction heating coil and the spray head are simultaneously energized.

After the lubricating material is applied to the workpiece, such as workpiece 21 illustrated in FIGS. 2 and 3, the workpiece can be released from the support mechanism 28 and transferred to a transport mechanism (not shown) for delivery to an apparatus for deforming the workpiece 21. Preferably, this deforming process is performed during the period of time following the retrogression heat treatment process, and after the application of the lubricating material, in which the workpiece 21 retains the full or partial softening characteristics. Any desired deforming process may be performed on the workpiece 12.

If, for example, the workpiece 21 is a closed channel structural member, the deforming process may be performed by hydroforming. Hydroforming, as described above, is a well known process that uses pressurized fluid to deform a closed channel structural member into a desired shape. To accomplish this, the closed channel structural member is initially disposed between two die sections of a hydroforming apparatus that, when closed together, define a die cavity having a desired final shape. Thereafter, the closed channel structural member is filled with a pressurized fluid, typically a relatively incompressible liquid such as water. The pressure of the fluid is increased to a magnitude where the closed channel structural member is expanded or otherwise deformed outwardly into conformance with the die cavity. As a result, the closed channel structural member can be deformed into the desired final shape for the vehicle frame component by the hydroforming process.

Because the inner surface of the hydroforming die is typically shaped differently from the outer surface of the closed channel structural member, one or more discrete portions of the outer surface of the closed channel structural member 21 will initially engage the inner surface of the hydroforming die prior to engagement by the remaining portions of the closed channel structural member 21. These initially engaging portions of the outer surface of the closed channel structural member 21 may become frictionally locked in position at the initial points of engagement because of the outwardly directed frictional forces generated by the high pressure hydroforming fluid. The apparatus and method of this invention allow liquid lubricant to be more evenly sprayed, and dried substantially immediately when so sprayed, thereby providing a coating of lubricant having a more uniform thickness than can be achieved by prior art methods. Such a uniform coating of lubricant minimizes the adverse effects of friction (i.e., the stretching and thinning) between the outer surface of the closed channel structural member 21 and the inner surface of the hydroforming die.

Referring to FIGS. 2 and 4, it is also desirable to move the workpiece 21, 31 through the induction heating coil 22, 32 in a manner that centers the workpiece 21, 31 relative to the internal walls of the induction heating coil 22, 32 so that the workpiece 21 is subjected to a relatively even distribution of electrical currents. Preferably, the support mechanism 28, 33 supports the workpiece 21, 31 and allows for relative movement of the workpiece 21, 31 such that the workpiece 21, 31 can move in a generally lateral direction relative to a longitudinal axis defined by the workpiece 21, 31. The electrical currents generated by the induction coil 22, 32 create a magnetic field about the workpiece 21, 31 and the magnetic field tends to center the workpiece 21, 31 relative to the induction coil 22, 32. Thus, if the support mechanism 28, 33 is misaligned with the induction coil 22, 32 or the shape of the workpiece 21, 31 is not true relative to its axis, the support mechanism 28, 33 will permit the workpiece 21, 31 to center itself relative to the induction coil 22, 32.

After desired deformation of the workpiece 21, 31 into a vehicle frame component, the vehicle frame component can be secured to one or more other vehicle frame components to form a vehicle frame assembly. The securing of such vehicle frame components may be performed in any conventional manner, such as by magnetic pulse welding.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method of applying a lubricating material to a surface of a workpiece comprising the steps of:

(a) providing a workpiece having a surface;

(b) providing a heating apparatus and a liquid coating apparatus;

(c) moving the workpiece through the heating apparatus to heat the surface of the workpiece to a predetermined temperature; and (d) while the workpiece is at the predetermined temperature, moving the workpiece through the liquid coating apparatus so as to apply a lubricating material on the heated surface of the workpiece such that the heated surface of the workpiece causes the lubricating material to dry and harden substantially immediately upon contact with the heated surface of the workpiece.

2. The method defined in claim 1 wherein step (b) is performed by providing an induction heating coil and a liquid coating apparatus and step (c) is performed by moving the workpiece through the induction heating coil.

3. The method defined in claim 1 wherein step (b) is performed by providing a heating apparatus and a spray ring and step (d) is performed by moving the workpiece through the spray ring.

4. The method defined in claim 1 wherein step (b) is performed by providing an induction heating coil and a spray ring, step (c) is performed by moving the workpiece through the induction heating coil, and step (d) is performed by moving the workpiece through the spray ring.

5. The method defined in claim 1 wherein step (b) is performed by providing the heating apparatus and a liquid coating apparatus adjacent to one another.

6. The method defined in claim 1 wherein step (b) is performed by providing the heating apparatus and a liquid coating apparatus spaced apart from one another.

7. The method defined in claim 1 wherein step (c) is performed by moving the workpiece vertically through the heating apparatus and the liquid coating apparatus.

8. The method defined in claim 1 wherein step (d) is performed by moving the workpiece vertically through the liquid coating apparatus.

9. The method defined in claim 1 wherein step (c) is performed by moving the workpiece vertically through the heating apparatus and step (d) is performed by moving the workpiece vertically through the liquid coating apparatus.

10. A method of performing a hydroforming process on a workpiece including a surface having a lubricating material thereon comprising the steps of:

(a) providing a workpiece having a surface;

(b) providing a heating apparatus and a liquid coating apparatus;

(c) moving the workpiece through the heating apparatus to heat the surface of the workpiece to a predetermined temperature;

(d) while the workpiece is at the predetermined temperature, moving the workpiece through the liquid coating apparatus so as to apply a lubricating material on the heated surface of the workpiece such that the heated surface of the workpiece causes the lubricating material to dry and harden substantially immediately upon contact with the heated surface of the workpiece; and (e) performing a hydroforming process on the coated workpiece.

11. The method defined in claim 10 wherein step (b) is performed by providing an induction heating coil and a liquid coating apparatus and step (c) is performed by moving the workpiece through the induction heating coil.

12. The method defined in claim 10 wherein step (b) is performed by providing a heating apparatus and a spray ring and step (d) is performed by moving the workpiece through the spray ring.

13. The method defined in claim 10 wherein step (b) is performed by providing an induction heating coil and a spray ring, step (c) is performed by moving the workpiece through the induction heating coil, and step (d) is performed by moving the workpiece through the spray ring.

14. The method defined in claim 10 wherein step (b) is performed by providing the heating apparatus and a liquid coating apparatus adjacent to one another.

15. The method defined in claim 10 wherein step (b) is performed by providing the heating apparatus and a liquid coating apparatus spaced apart from one another.

16. The method defined in claim 10 wherein step (c) is performed by moving the workpiece vertically through the heating apparatus and the liquid coating apparatus.

17. The method defined in claim 10 wherein step (d) is performed by moving the work piece vertically through the liquid coating apparatus.

18. The method defined in claim 10 wherein step (c) is performed by moving the workpiece vertically through the heating apparatus and step (d) is performed by moving the workpiece vertically through the liquid coating apparatus.

* * * * *